US007784403B2

(12) United States Patent
Moulard et al.

(10) Patent No.: US 7,784,403 B2
(45) Date of Patent: Aug. 31, 2010

(54) OPTICALLY DOPED ENERGETIC IGNITER CHARGE

(75) Inventors: Henry Moulard, Saint Louis (FR); Auguste Ritter, Village Neuf (FR); Jean-Marie Brodbeck, Uffheim (FR)

(73) Assignee: Deutsch-Franzosisches Forschungsinstitut, Saint-Louis (FR)

( * ) Notice: Subject to any disclaimer, the term of this patent is extended or adjusted under 35 U.S.C. 154(b) by 932 days.

(21) Appl. No.: 11/482,075

(22) Filed: Jul. 5, 2006

(65) Prior Publication Data

US 2007/0113941 A1 May 24, 2007

(30) Foreign Application Priority Data

Jul. 5, 2005 (FR) ..... 05 07158

(51) Int. Cl.
*F42C 19/00* (2006.01)
*C06B 33/08* (2006.01)

(52) U.S. Cl. ..... 102/201; 149/38; 149/108.2

(58) Field of Classification Search ..... 102/201; 149/38, 108.2
See application file for complete search history.

(56) References Cited

U.S. PATENT DOCUMENTS

| | | | | |
|---|---|---|---|---|
| 3,374,127 A | | 3/1968 | Jenner et al. | |
| 3,528,864 A | | 9/1970 | Weinland | |
| 4,316,412 A | * | 2/1982 | Dinegar et al. | 102/202.5 |
| 4,989,515 A | * | 2/1991 | Kelly et al. | 102/202.9 |
| 5,101,729 A | * | 4/1992 | Noble et al. | 102/275.8 |
| 2003/0173008 A1 | * | 9/2003 | Lee | 149/19.2 |
| 2006/0096484 A1 | * | 5/2006 | Moulard et al. | 102/201 |

FOREIGN PATENT DOCUMENTS

| | | |
|---|---|---|
| EP | 0365503 A | 4/1990 |
| EP | 1052113 A | 11/2000 |
| EP | 1306643 A | 5/2003 |
| EP | 1481802 A | 12/2004 |
| FR | 2831659 A | 5/2003 |
| GB | 1263574 A | 2/1972 |
| WO | WO 99/00343 A | 1/1999 |
| WO | WO 00/11428 A | 3/2000 |
| WO | WO 2005/057651 A | 6/2005 |

OTHER PUBLICATIONS

"Investigation of Laser Initiation of Pyrotechnic Substances", Chemical Abstracts, vol. 112, No. 8, Feb. 19, 1990.
European Search Report, Appl. No. 06002905.5, dated May 26, 2006.

* cited by examiner

*Primary Examiner*—Aileen Felton
(74) *Attorney, Agent, or Firm*—Michaud-Kinney Group LLP

(57) ABSTRACT

The invention relates to an energetic igniter charge consisting of a mixture of at least one secondary explosive and an optical doping material in powder form. In accordance with the invention, the optical doping material is a metal. The energetic igniter charge can be used in a detonator as well as in an igniter.

18 Claims, 1 Drawing Sheet

OPTICALLY DOPED ENERGETIC IGNITER CHARGE

FIELD OF THE INVENTION

The present invention relates to an energetic igniter charge for the use in an optical detonator (igniter with explosive) or an optical initiator (igniter with pyrotechnic mixture).

BACKGROUND OF THE INVENTION

Laser sources used in detonators must be robust, space saving and economical, especially for military or astronautical applications. They are therefore either Nd-YAG-solid lasers (for military applications) with a power density of about 3 $MW \cdot cm^{-2}$ or laser diodes with, generally, 1 W power output (for astronautical applications) and a power density of about 20 $KW \cdot cm^{-2}$, which is too low for direct initiation of the secondary explosive detonation, for which a power density of about 1 $GW \cdot cm^{-2}$ is required.

These power densities lead, however, to a temperature increase of the secondary explosive in the first detonator stage up to the achievement of the self-sustaining decomposition temperature at which subsequently a very violent breakdown reaction takes place by which the secondary explosive detonation in the second stage is initiated (depending on the detonator configuration and the characteristics of the secondary explosives used) either by a deflagration-detonation transition process or a percussion-detonation transition process. However, since the secondary explosives do not absorb the light in the near infrared range emitted by the laser sources, the energetic igniter charge in the first detonator stage is a mixture of secondary explosive and soot powder which is used as optical doping material (absorbs the radiation emitted by the laser sources and transfers the required heat energy for the achievement of the critical temperature of the secondary explosive).

The effectiveness of soot however decreases strongly in applications in which the detonator is exposed to extreme climatic conditions. For the validation of a detonator for such an application, experiments must be conducted emulating a temperature variation stress according to the requirements of this application. In the field of astronautics, such a temperature variation stress includes, for example, a temperature increase to 100° C. during five hours as well as a subsequent cooling down to room temperature. When a laser diode is used as the laser source, ignition of the secondary explosive mixture with 1 percent by weight (wt. %) soot no longer occurs after such a temperature variation stress even with a maximum diode power of 1 W, although a power of 0.1 W is normally sufficient for ignition of the detonator.

A first solution to the problem of providing the required high power laser source for ignition of a detonator under such difficult climatic conditions is described in French Patent FR 2 831 659, according to which a pyrotechnic redox mixture is placed in the first detonator stage between the secondary explosive and the optical focusing interface which absorbs light in the infrared range and initiates a redox reaction in which the required heat energy for ignition of the secondary explosive is released. The pyrotechnic mixture used (ZPP) is however generally very sensitive to friction and electrostatic discharges.

Furthermore, for a reliable ignition of the pyrotechnical redox mixture in optical initiators with the use of a laser diode (especially 1-W laser diode) as laser source, pyrotechnic mixtures must be used, the reducing agent of which has a very fine particle size (typically between 1 and 2 μM). However, because of this particle size, the pyrotechnical redox mixture is extremely sensitive to friction and electrostatic discharges, which leads to dangerous manufacture and handling.

It is now an object of the present invention to ignite an optical igniter (detonator or initiator) with a laser source of low power and to provide a solution for the above mentioned problem inherent with igniters of the last generation.

SUMMARY OF THE INVENTION

In accordance with the invention, the igniter includes an energetic igniter charge with a mixture of at least a secondary explosive and a metal in powder form, whereby the metal serves as optical doping material.

The ignition of the main igniter charge of the igniter (secondary explosive in the case of a detonator or pyrotechnical mixture in the case of an initiator) is possible with such a mixture even with a laser source of low power, such as, for example, a laser diode with a power of 1 W, and a simultaneous reduction of the risks during handling of the main igniter charge is achievable.

BRIEF DESCRIPTION OF THE DRAWINGS

Further advantages and particularities of the present invention are apparent from the description of the embodiments as non-exhaustive examples of the invention, which are illustrated in the enclosed drawings.

DETAILED DESCRIPTION OF THE PREFERRED EMBODIMENTS

The energetic igniter charge 1 in accordance with the invention consists of a mixture of at least one secondary explosive and a metal in powder form, which serves as optical doping material.

Figure 1:
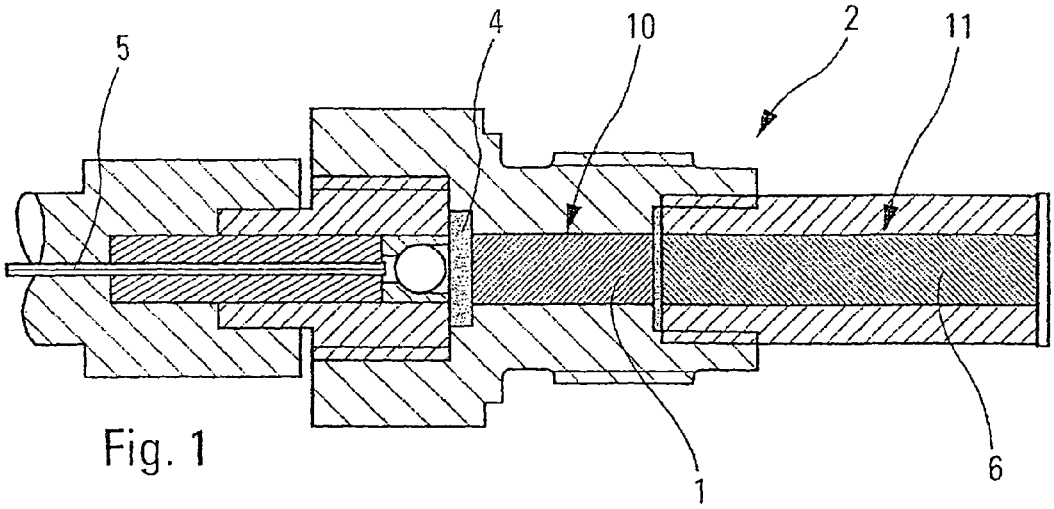
FIG. 1 is a cross-section of an optical detonator, whereby an energetic ingniter charge in accordance with the invention is found in the cavity of the first detonator stage as the main igniter charge of the detonator.
Figure 2:
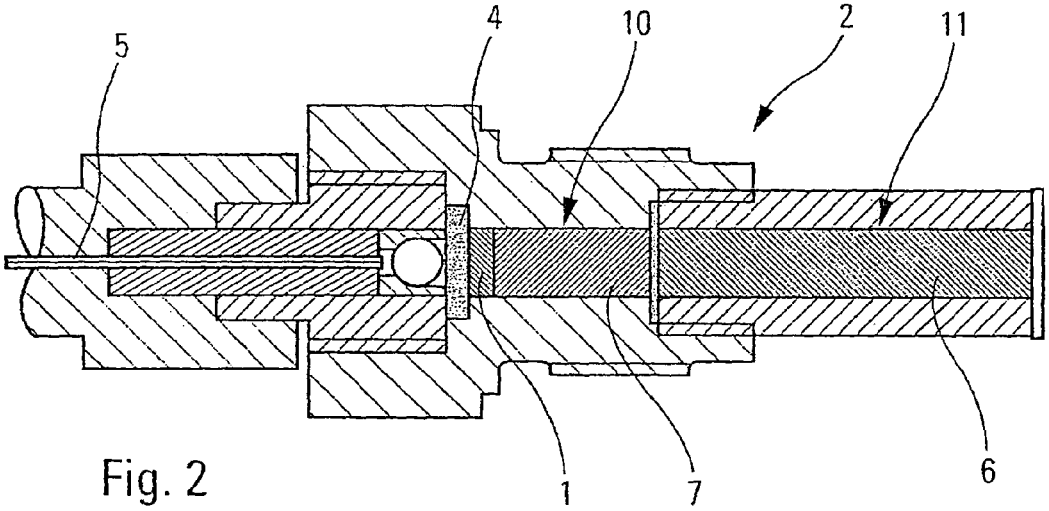
FIG. 2 shows a cross-section of an optical detonator with an igniter charge in accordance with the invention and a main igniter charge of secondary explosive in the cavity of the first detonator stage.
Figure 3:
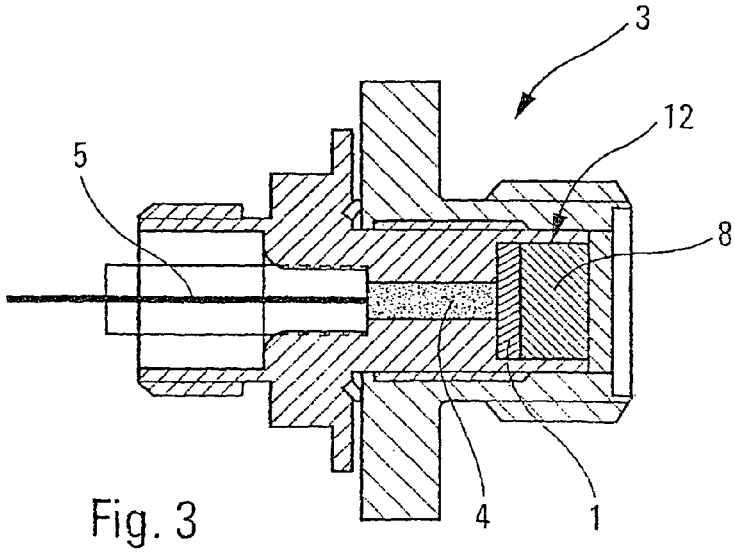
FIG. 3 is a cross-section of an optical initiator, having in its cavity an energetic igniter charge in accordance with the invention and a main igniter charge of a pyrotechnical mixture.

As illustrated in FIGS. 1 to 3, the energetic igniter charge 1 is found during its use in a cavity of an optical igniter 2,3 and is in contact with an optical focusing interface 4 which closes the cavity and through which the energetic igniter charge 1 is supplied with infrared radiation emitted from a laser radiation source and guided from the radiation source through a light conductor 5 to the optical focusing interface 4, whereby one end of the light conductor is connected with the laser radiation source and the other with the optical focusing interface 4.

The metal used has the property that it absorbs the infrared light emitted by the laser source and, because of its good homogeneous admixture with a secondary explosive, transmits the stored heat by way of heat conduction to this explosive, whereby the ignition of the secondary explosive is initiated.

For efficient heating of the secondary explosive by the metal, the metal should have a temperature conductivity of at least $10^{-5}$ $m^2 \cdot s^{-1}$, preferably at least $5 \cdot 10^{-5}$ $m^2 \cdot s^{-1}$ or even $9 \cdot 10^{-5}$ $m \cdot s^{-1}$, whereby the temperature conductivity is defined as the quotient of heat conductivity and the product of heat capacity and density of the respective metal. The metal used can thereby be aluminum ($9.8\cdot10^{-5}$ $m^2\cdot s^{-1}$), an aluminum alloy (Al2024 "Dural" with a conductivity of $4.5\cdot10^{-5}$ $m^2\cdot s^{-1}$), tungsten ($6.8\cdot10^{-5}$ $m^2\cdot s^{-1}$), copper ($11.7\cdot10^{-5}$ $m^2\cdot s^{-1}$), magnesium or a magnesium alloy ($11.7\cdot10^{-5}$ $m^2\cdot s^{-1}$) and even nickel, zirconium or titanium. Aluminum is preferably used because of its high temperature conductivity and low cost.

Since the metal is used for its physical properties regarding the absorption of infrared light and heat transfer and not for its chemical properties (as in aluminum containing explosives), a small amount is sufficient. The metal portion is therefore at most 10 wt. %, preferably at most 5 wt.% or even about 1 wt. % of the energetic igniter charge 1. The higher the metal portion, the shorter the ignition time of the energetic igniter charge 1, whereby this igniter charge at more than 5 wt. % in cases where very short ignition times are not required has an unnecessarily high sensitivity during standard safety testing (percussion, friction, electrostatic discharges).

The secondary explosive used in the energetic igniter charge 1 can be, for example, octogen (HMX), hexogen (RDX) or hexanitrostilbene (HNS). This energetic igniter charge 1 can also include several secondary explosives, such as, for example, octogen and hexanitrostilbene, whereby the latter has relatively low friction sensitivity.

Furthermore, the specific contact surface between the secondary explosive and the metal should be as large as possible so that the temperature increase of the secondary explosive occurs at high speed and a short and reproducible reaction time of the optical igniter 2,3 is achieved. The secondary explosive is therefore preferably in powder form and has a particle size of less than 6 μm (preferably less than 3 μm). The metal is also a fine powder and has an average particle size of less than 6 μm, preferably less than 2 μm or even 1 μm, which conforms to the wavelength of the emitted laser light.

To reduce the operating time of the igniter 2,3 (as well as the threshold laser source power density required for initiation of the composition of the energetic igniter charge 1), the energetic igniter charge 1 in accordance with the invention is pressed into the cavity at a high loading density, preferably over 80% of the maximum nominal density of the igniter charge 1.

For an easier admixture of the energetic igniter charge 1, this process should preferably be carried out mechanically by wetting with the admixture of a dispersion agent for the prevention of lump formation (for example isopropanol), which is subsequently removed by drying.

The energetic igniter charge 1 can also include an inert polymer binder or wax (preferably at a portion of at most 5 wt. % of the mixture) in order to reduce its sensitivity to mechanical stress in the standard safety tests. Graphite can also be admixed in order to use the lubricant capabilities of this material and to guarantee a higher safety during use of the energetic igniter charge 1.

Furthermore, an especially homogeneous mixture of secondary explosive and metal must be obtained in order to ensure a reliable ignition and a reproducible reaction time of the optical igniter 2,3. This should especially be achieved, since the radiation can only be absorbed by the metal in a very small effective cavity region: the laser spot at the output of the optical focusing interface 4 has a similar diameter as the light conductor 5 (the diameter can be reduced to 50 μm) and the absorption thickness lies in the same order of magnitude.

The use of such an energetic igniter charge 1 in an optical detonator 2 is illustrated in FIGS. 1 and 2. A conventional optical detonator 2 includes two stages: the laser source ignites by heating an energetic main igniter charge (a mixture mainly of one or two secondary explosives) in the cavity 10 of the first stage, in which subsequently a very violent decomposition reaction takes place, by which (depending on the configuration of detonator 2 and the characteristics of the secondary explosives used in the first and second stage) the detonation of a secondary explosive 6 in the cavity 11 of the second stage is initiated either by a deflagration-detonation-transition process or a percussion-detonation-transition process.

A detonator 2 is illustrated in FIG. 1, the energetic main igniter charge of which consists of the energetic igniter charge 1 in accordance with the invention.

Experiments were conducted using a 1 W diode as laser source, which was connected with the optical interface 4 by a light conductor 5 with 62.5 μm diameter, in order to validate the igniter charge 1 in accordance with the invention for astronautical applications, in which (in view of the importance of energy conservation in this field) the ignition threshold is determinative. In these experiments, the igniter charge 1 is loaded into the cavity of the first stage at a density of about 1.7 $g\cdot cm^{-3}$, whereby the detonator 2 was exposed to a temperature variation test with a 5 hour long temperature stress at 100° C. and subsequent cooling to room temperature. In a first detonator, the igniter charge 1 consists of octogen with a mean particle size of 2.5 μm and 1 wt. % aluminum with a mean particle size of 5 μm; in a second detonator, the igniter charge 1 consists of octogen with a mean particle size of 2.5 μm and 1 wt. % aluminum with a mean particle size of 160 nm. In both experiments, the ignition threshold was 110 mW. These experiments show the efficiency of fine powder aluminum as optical doping material even in small amounts. A large functional range can be ensured with such a low ignition threshold, since the diode can deliver a power of 1 W.

Further experiments were conducted with the use of a compact Nd-YAG-solid laser source with a power density of 3 $MW\cdot cm^{-2}$ (100 times higher than in the 1 W laser diode), in order to validate the igniter charge 1 in accordance with the invention for military applications in which the reaction time of the detonator and its reproducibility (for the serial ignition of several warheads) is determinative. The laser source used in these applications can be a solid laser which delivers a sufficiently high energy amount so that the ignition threshold does not provide any problems. In these experiments, the igniter charge 1 was loaded into the cavity of the first stage at a density of about 1.7 $g\cdot cm^{-3}$, whereby the detonator was subjected to a temperature change test with a 5 hour long temperature stress at 100° C. and subsequent cooling to room temperature. In a first detonator, the igniter charge 1 consisted of octogen with a mean particle size of 2.5 μm and 1 wt. % aluminum with a mean particle size of 5 μm; in a second detonator the igniter charge consisted of octogen with a mean particle size of 2.5 μm and 1 wt. % aluminum with a mean particle size of 160 nm. In the first experiment, the variation of the reaction time was about 10 μs (compared to 30 μs with an energetic igniter charge of a mixture of secondary explosive and soot) and in the second experiment the variation was below 2 μs, whereby the detonator has an operating time of 41 μs. In order to comply with the requirements reproducibility of the operating time, the aluminum must have a particle size below (or somewhat above) 1 μm.

A detonator 2 is illustrated in FIG. 2 in which the energetic igniter charge 1 in accordance with the invention is located in the form of a fine layer between the optical focusing interface 4 and an energetic main igniter charge 7 (a mixture mainly of 1 or more secondary explosives, such as, for example, octogen, hexogen, hexanitrostilbene . . . , without optical doping material), which is located in the same cavity 10 as the energetic igniter charge 1 in accordance with the invention, whereby the energetic main igniter charge 7 can be ignited with the energy released during the decomposition of the energetic igniter charge 1 in accordance with the invention.

Good results are achieved with this special embodiment because of the small thickness of the effective cavity region. This can lead to cost savings with the use of the energetic igniter charge 1 in accordance with the invention. A very laser ignition insensitive and safe explosive, such as for example hexanitrostilbene, can therefore also be used as a secondary explosive in the energetic main igniter charge 7, or other secondary explosives with very high decomposition temperatures.

FIG. 3 illustrates the use of an energetic igniter charge 1 in accordance with the invention in an optical initiator 3. A conventional optical initiator 3 includes a single stage: the laser source ignites by heating an energetic main igniter charge (mainly consistent of a pyrotechnical redox mixture) in the cavity 12 of the initiator 3, during which combustion reaction heat in the form of radiation, hot solids particles and some hot gas is released, whereby the burning of an external propulsive charge (propellant powder in the interior of the body of a pyrotechnical device, such as for example adjustes, cylinder, . . . or solid propulsive charge inside the housing of a rocket motor).

An initiator 3 is shown in FIG. 3 in which the energetic igniter charge 1 in accordance with the invention is in the form of a fine layer between the optical focusing interface 4 and an energetic main igniter charge 8 (mainly consisting of a pyrotechnical mixture), which is positioned in the same cavity 12 as the energetic igniter charge 1 in accordance with the invention, whereby the energetic main igniter charge 8 can be ignited with the energy released during decomposition of the energetic igniter charge 1 in accordance with the invention.

The pyrotechnical mixture 8 (mixture of a fine powder reducing agent and a mineral oxidation agent) can be, for example, the mixture ZPP (essentially a mixture of zirconium and potassium peschlorate) or BNP (essentially a mixture of borium (boron) and potassium nitrate).

Since the energetic igniter charge 1 in accordance with the invention has a very low sensitivity to friction and electrostatic discharges, pyrotechnical safety mixtures 8 can be used which have a reduced sensitivity to friction and electrostatic charges. Such a pyrotechnical main mixture 8 can be, for example, BNP or a ZPP-mixture optimized for safety purposes (zirconium with a larger particle size).

What is claimed is:

1. An optical igniter, comprising a cavity, an energetic igniter charge comprising at least one secondary explosive admixed with optical doping material in powder form, the optical doping material being a metal, an optical focusing interface sealing the cavity and being in contact with the igniter charge; and a light conductor having a first end for receiving light from a laser radiation source and a second end connected to the optical focusing interface.

2. The optical igniter according to claim 1, wherein the igniter is an optical detonator, and the optically doped energetic igniter charge serves as an energetic main igniter charge in a first stage of the detonator.

3. The optical igniter according to claim 1, wherein the igniter is an optical detonator, the optically doped energetic igniter charge is positioned between the optical focusing interface and an energetic main igniter charge consisting mainly of a secondary explosive and located in the cavity.

4. The optical igniter according to claim 1, wherein the igniter is an optical initiator, where the optically doped energetic charge is positioned between the optical focusing interface and an energetic main igniter charge consisting mainly of a pyrotechnical mixture in the cavity.

5. The optical igniter according to claim 1, wherein the optically doped energetic igniter charge is compressed to a density of about 80% of its maximum nominal density.

6. The optical igniter according to claim 1, wherein the metal in the energetic igniter charge has a temperature conductivity of at least $10^{-5}$ $m^2 \cdot s^{-1}$.

7. The optical igniter according to claim 1, wherein the metal in the energetic igniter charge has a temperature conductivity of at least $5 \cdot 10^{-5}$ $m^2 \cdot s^{-1}$.

8. The optical igniter according to claim 1, wherein the metal in the energetic igniter charge has a temperature conductivity of at least $9 \cdot 10^{-5}$ $m^2 \cdot s^{-1}$.

9. The optical igniter according to claim 1, wherein the metal in the energetic igniter charge includes aluminum, an aluminum alloy, tungsten, copper, magnesium, a magnesium alloy, or a combination of any one or more thereof.

10. The optical igniter according to claim 1, wherein the metal in the energetic igniter charge has a mean particle size below 6 μm.

11. The optical igniter according to claim 1, wherein the portion of the metal in the igniter charge is at most about 10 wt. %.

12. The optical igniter according to claim 11, wherein the portion of the metal in the igniter charge is at most about 5 wt. %.

13. The optical igniter according to claim 12, wherein the metal has a mean particle size below 2 μm.

14. The optical igniter according to claim 13, wherein the metal has a mean particle size of about 1 μm.

15. The optical igniter according to claim 12, wherein the portion of the metal in the igniter charge is at most about 1 wt. %.)

16. The optical igniter according to claim 1, wherein the secondary explosive is octogen (HMX), hexogen (RDX), or hexanitrostilbene (HNS), or mixtures thereof.

17. The optical igniter according to claim 16, including hexanitrostilbene (HNS) and at least one further secondary explosive.

18. The optical igniter according to claim 1, wherein the secondary explosive is a powder with a particle size below 3 μm.

* * * * *